US005433432A

United States Patent [19]

Adler

[11] Patent Number: 5,433,432

[45] Date of Patent: Jul. 18, 1995

[54] BED BASKETBALL

[75] Inventor: Frank Adler, Aqoura, Calif.

[73] Assignee: Hersch and Company, Los Angeles, Calif.

[21] Appl. No.: 111,938

[22] Filed: Aug. 26, 1993

[51] Int. Cl.[6] ..... A63B 63/08

[52] U.S. Cl. ..... 273/1.5 R; 5/503.1; 5/659

[58] Field of Search ..... 273/1.5 R, 1.5 A, 399, 273/402, 85 R, 85 C, 85 F, 331; D21/201; 5/503.1, 505.1, 659; 248/291; 16/257, 260, 374; 403/117

[56] References Cited

U.S. PATENT DOCUMENTS

| | | | |
|---|---|---|---|
| 1,313,827 | 8/1919 | Laxman et al. | 248/291 X |
| 1,508,147 | 9/1924 | Vinal | 273/85 R |
| 2,707,634 | 5/1955 | Johnson . | |
| 3,026,079 | 3/1962 | Stack | 5/503.1 X |
| 3,288,466 | 11/1966 | Cumings | 273/331 X |
| 3,603,588 | 9/1971 | Ebstein | 273/1.5 R |
| 3,820,784 | 6/1974 | Boitano et al. | 248/291 X |
| 4,291,885 | 9/1981 | Cohen | 273/1.5 A X |
| 4,465,255 | 8/1984 | Hill | 5/503.1 X |
| 4,561,549 | 12/1985 | Yokohori | 5/659 X |
| 4,802,252 | 2/1989 | Marmor | 5/505.1 |
| 4,916,968 | 4/1990 | Kabaya | 16/257 X |
| 4,942,271 | 7/1990 | Corsi et al. | 403/117 X |
| 5,123,653 | 6/1992 | Murphy et al. | 273/85 R X |
| 5,192,080 | 3/1993 | Duncan | 273/1.5 R X |
| 5,232,217 | 8/1993 | Cota et al. | 273/1.5 A |

FOREIGN PATENT DOCUMENTS

| | | | |
|---|---|---|---|
| 1306254 | 9/1962 | France | 16/257 |
| 2216496 | 10/1989 | United Kingdom | 16/257 |

OTHER PUBLICATIONS

Schaper Toys Catalog 1948-1978, Mar. 1978 p. 21 Super Jock.

Hong Kong Trade Development Council, Hong Kong Toys 1992, Mar. 1992, p. 269, No. 6338 Basketball Game.

Korney Board Aids, Basketball Coaching and Training Aids 1989 School Mail Order Catalog, Dec. 1989, p. 41, KBA Quite-Ball.

*Primary Examiner*—Paul E. Shapiro

*Attorney, Agent, or Firm*—Melvin L. Crane

[57] ABSTRACT

A basketball game which can be played in bed by a sick person for exercise. The basketball hoop is secured to the backboard by use of integral end supports which fit into spaced spring-like fingers. The back of the hoop has a downwardly extending integral support which prevents the hoop from falling below a horizontal position perpendicular to the backboard. The hoop has a slot in the front and the net is slit so that a ball attached to a line can pass through the hoop and the line can pass through the slot and slit so that the player can retrieve the ball. The backboard is supported by a base which has frontward extending pieces that will fit between a mattress and spring for supporting the backboard and hoop in an upright position.

9 Claims, 5 Drawing Sheets

BED BASKETBALL

This invention is directed to a miniature Basketball Fun Device and more particularly to a basketball game which can be played in bed by a person confined to the bed.

Heretofore there has been developed a tethered basketball practice devise, U.S. Pat. No. 3,288,466, having a backboard with a hoop and net attached into which a tethered basketball is thrown for practice shooting baskets. The hoop is provided with a slit in the front along a diameter of the hoop so that the line to which the basketball is attached will pass through the slit in the hoop when a basket is made by the player.

Another fun device has been set forth in U.S. Pat. No. 3,599,976 which is provided with a plate having clamps by which the game device can be secured to a table top. The game device may be provided with a backboard and a hoop with a net through which a basketball may be thrown. The backboard could be provided with a dart board such that darts could be thrown toward the dartboard.

U.S. Pat. No. 2,707,634 is directed to a bed frame having a target which can be controlled from a bed and which is used to play specific games according to rules developed for the game.

This invention is directed to a basketball game which can be played by children confined to a bed. However, the device could be set up any place for use by any person.

An object of the invention is to throw a basketball of a miniature size into a hoop secured to a backboard. The hoop is split along a diameter perpendicular to the backboard and a line is secured to the basketball and held by the player by a loose end of the line so that the ball may be pitched or thrown toward the backboard. If the ball goes into the basket the ball will pass through the basket and the attached line will pass through the slit in the hoop so that the ball can be retrieved and thrown again toward the backboard. The basketball game is provided with a supporting base such that the device may be supported in an upright position between the mattress and spring. The supporting base may be made so that it will stand on the floor or or ground for use other than by a person confined to a bed.

It is therefore an object of the invention to provide a basketball game which can be played while confined to a bed as well as when ambulatory.

Another object is to provide a basketball game in which the ball is retrieved without having to chase after the ball.

Still another object of the invention is to provide a portable basketball game which can be easily assembled by a child without having to bother an adult.

Other and further objects of this invention will become apparent from a review of the drawings, in which.

DETAILED DESCRIPTION

Figure 1:
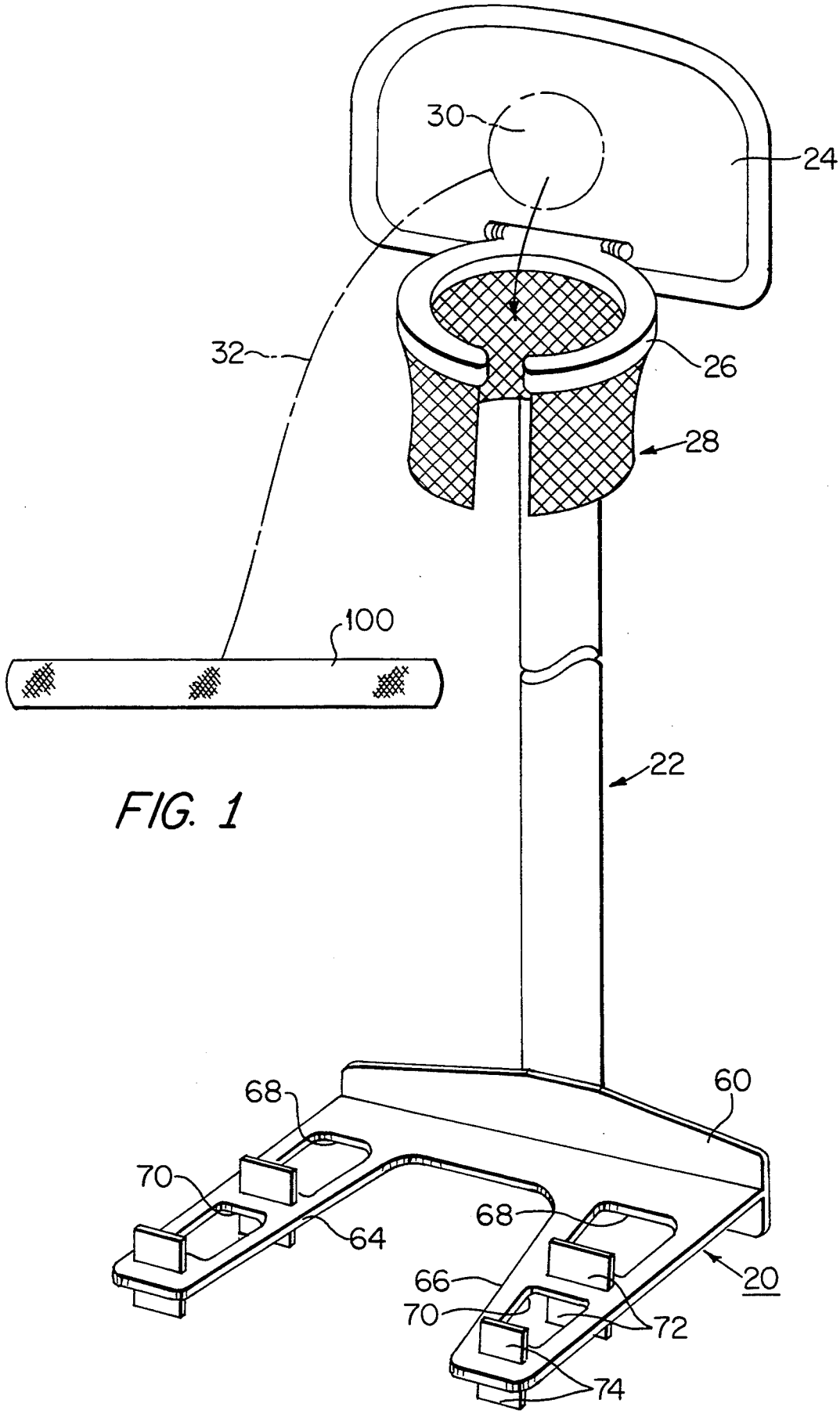
FIG. 1 is a perspective view of the device with the ball shown directed toward the backboard.

Now referring to the drawings where the same references illustrate the same parts. FIG. 1 illustrates a perspective view illustrating the assembled device including a supporting base 20, a vertical support 22, a backboard 24, a hoop 26, a net 28 and a ball 30 with an attached line 32. The loose end of the line is connected with a strap 100 as shown in FIG. 1 which fits around the wrist of a user so that the ball can be retrieved by the line after having been thrown.

Figure 2:
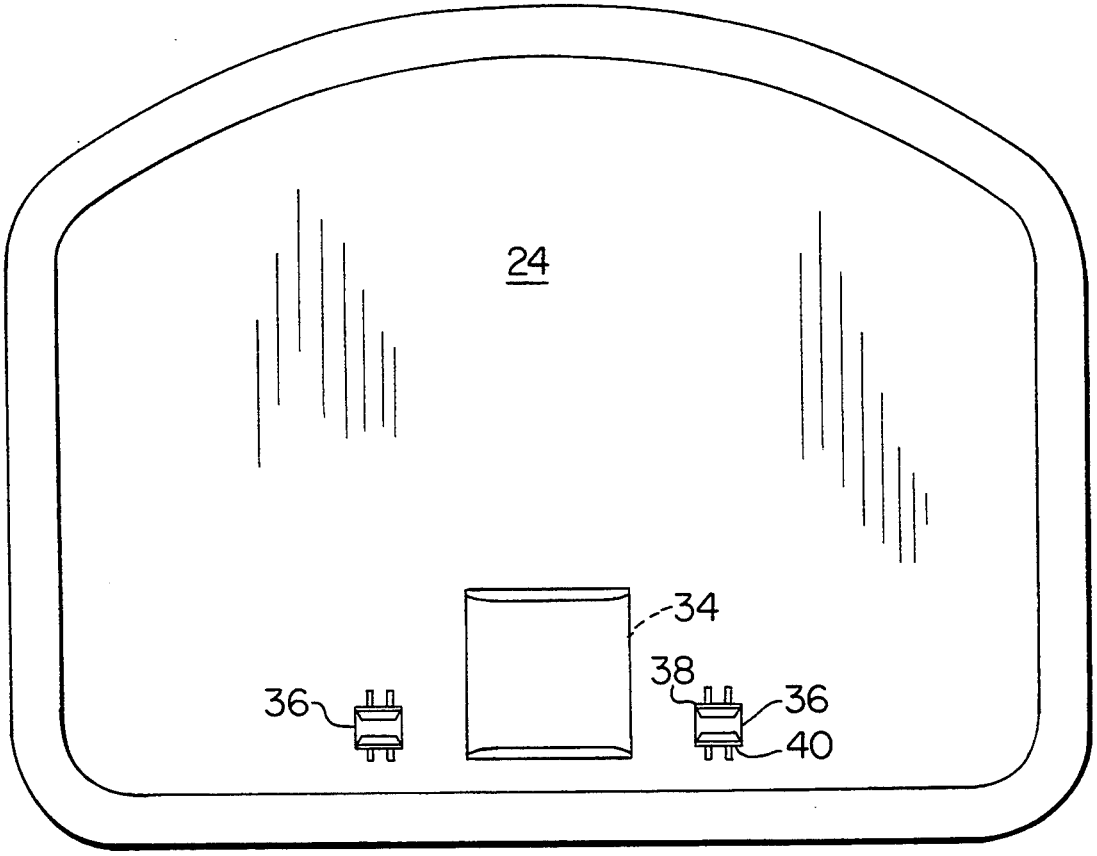
FIG. 2 illustrates a front view of the backboard.
Figure 10:
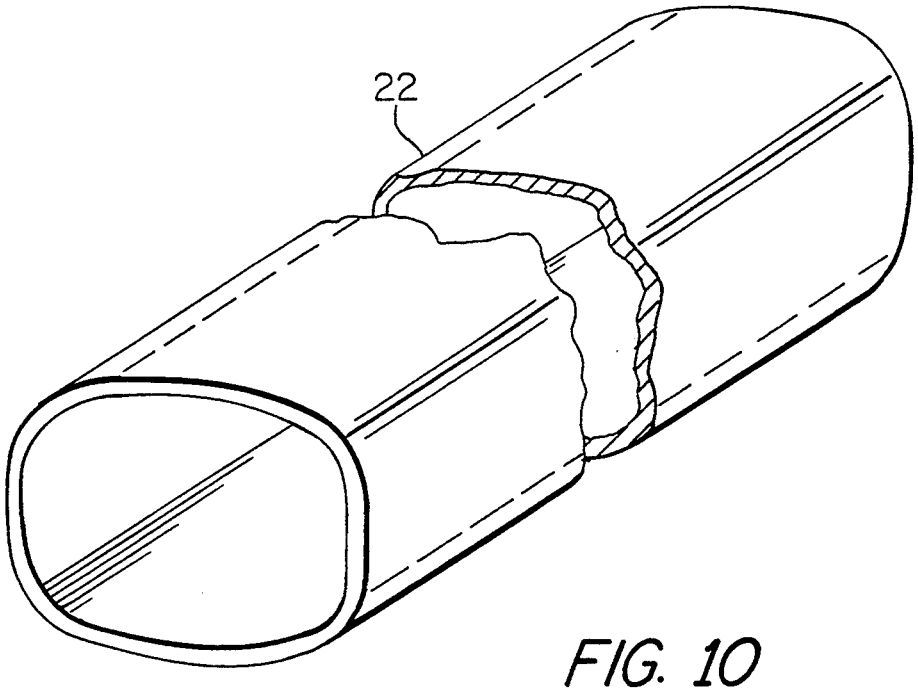
FIG. 10 illustrates a support for the backboard.
Figure 3:
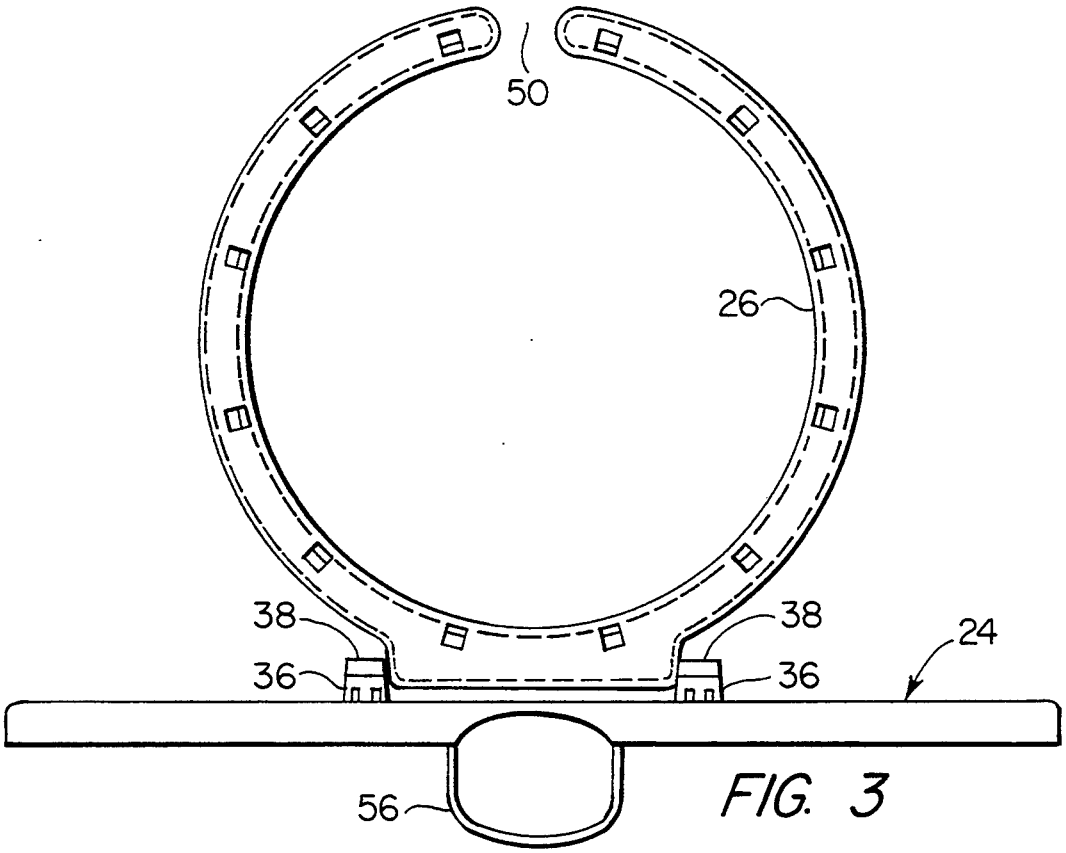
FIG. 3 is a top view illustrating the hoop secured to the backboard.
Figure 4:
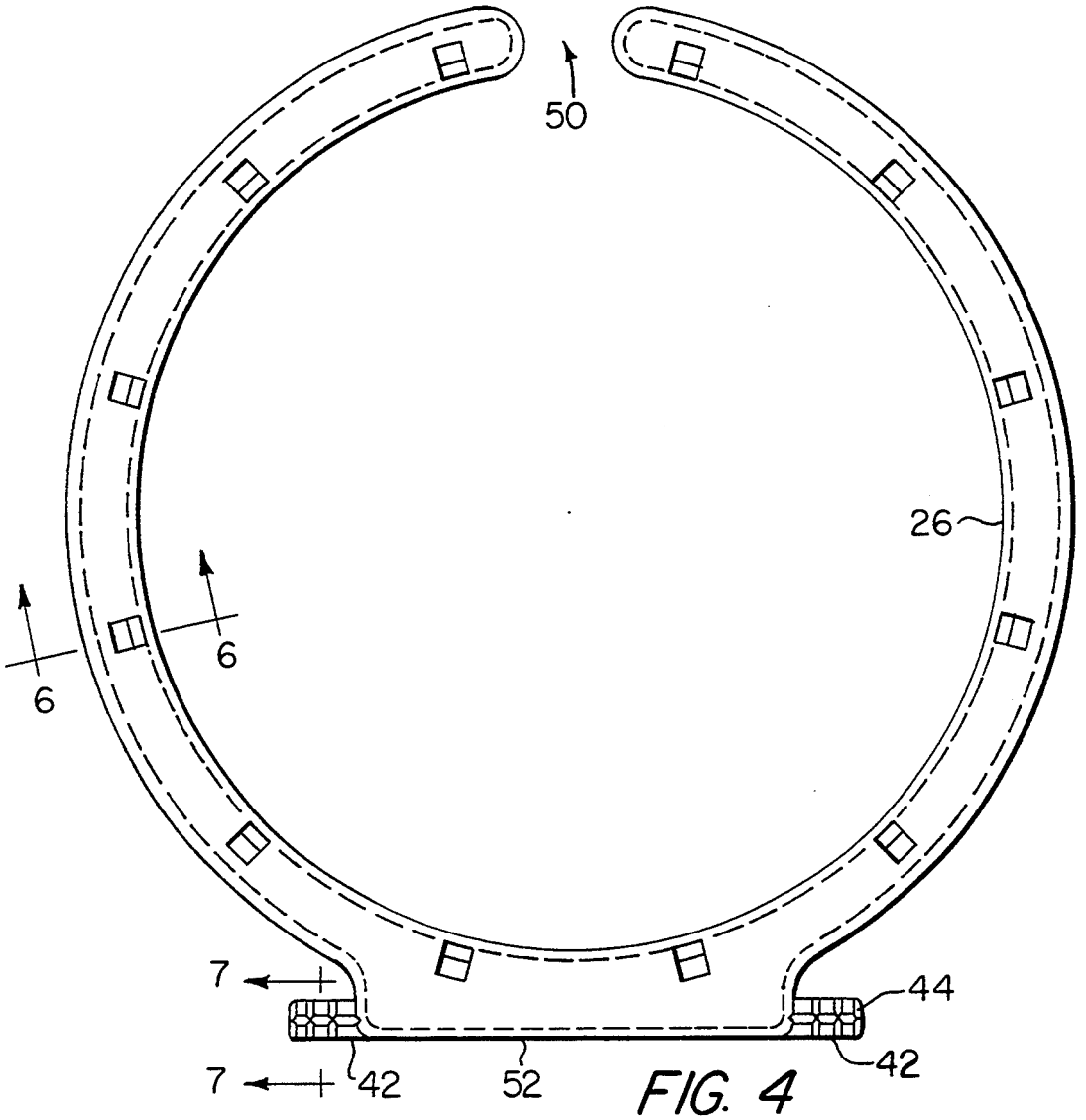
FIG. 4 illustrates a top view of the hoop.
Figure 5:
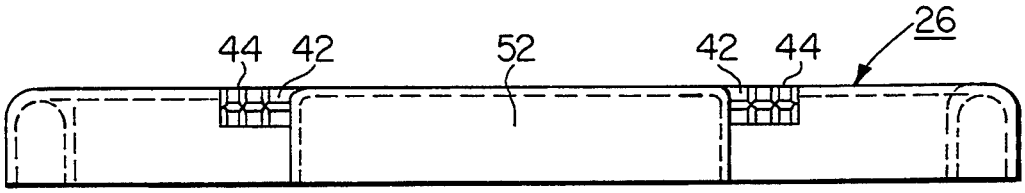
FIG. 5 is a rear view of the hoop.
Figure 7:
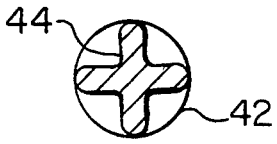
FIG. 7 is a view along lines 7—7 of FIG. 4.
Figure 6:
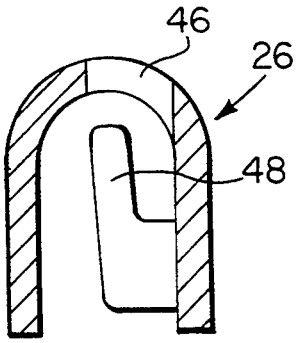
FIG. 6 is a view along lines 6—6 of FIG. 4.
Figure 12:
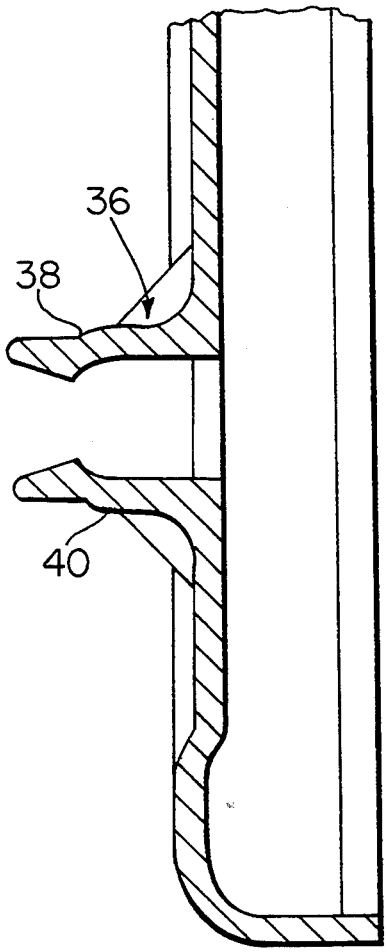
FIG. 12 illustrates a cross sectional view of the clips which secure the hoop to the backboard.

FIG. 2 illustrates the backboard 24. The backboard can be of any shape and made of plastic, glass, wood, metal or any other material. The backboard as well as the remainder of the parts should be of light weight material such as polypropylene and made without any sharp edges by which a person could be injured. The backside of the backboard is provided with an open holder 34 and the front surface near the bottom edge is provided with horizontally spaced clips 36 which are provided to support the hoop 26 and shown in a cross sectional view FIG. 12. The clips 36 are open from the front including an upper arm 38 and a lower arm 40. As shown the arms are angled on the front and the front opening is narrower than the back portion. The clips are expandable in opposite directions in order to receive end supports 42 on the hoop. The end supports are round with spaced star shaped positions 44 as shown in a cross sectional view FIG. 7. The diameter of the hoop supports 42 is greater than the opening to the clips 36 so that the clips expand outward as the supports are snapped into the clips. The diameter of the hoop supports is substantially the same as the spacing of the main body of the clips 36 so that the hoop supports are held tight within the clip. The back end 52 of the hoop is of solid plastic and in a plane perpendicular with a plane of the upper surface of the hoop and extends downwardly alongside the front bottom surface of the backboard so that the hoop is held up in a substantually perpendicular alignment with the front face of the backboard. FIGS. 3, 4 and 5 illustrate the hoop and the connection to the clips. The hoop has the shape of an inverted-U in cross section which is shown in dotted line in FIG. 5 and in cross section in FIG. 6. The hoop is provided with spaced openings 46 as shown in FIG. 6, by which the net 28 is secured to a hanger 48 integral with the hoop. As shown the hoop has a slit 50 on a diameter which is perpendecular with the back support end 52.

A vertical support 22 such as a plastic tube of round, oval, square or any other shape may be used. The vertical support may be made in more than one section which can be held together by a coupling 52 in which each end of the coupling fits into one end of an adjacent support tube. The coupling is provided with a central rib 54 upon which the adjacent end of the support tube fits. The upper end of the vertical support fits into a holder 56 which is secured to the back of the backboard on a centerline near the lower edge and between the clips 36 to which the hoop is connected. The upper end of the holder is shaped to receive the vertical support. The coupling could be used at the upper end of the vertical support so that one end of the coupling fits into the holder and the rib prevents the coupling from passing through the holder and also supports the upper end of the vertical support. The lower end of the vertical support fits into a like holder 58 on the backside of the support base 20. A coupling could also be used for connection of the vertical support to the support base.

Figure 8:
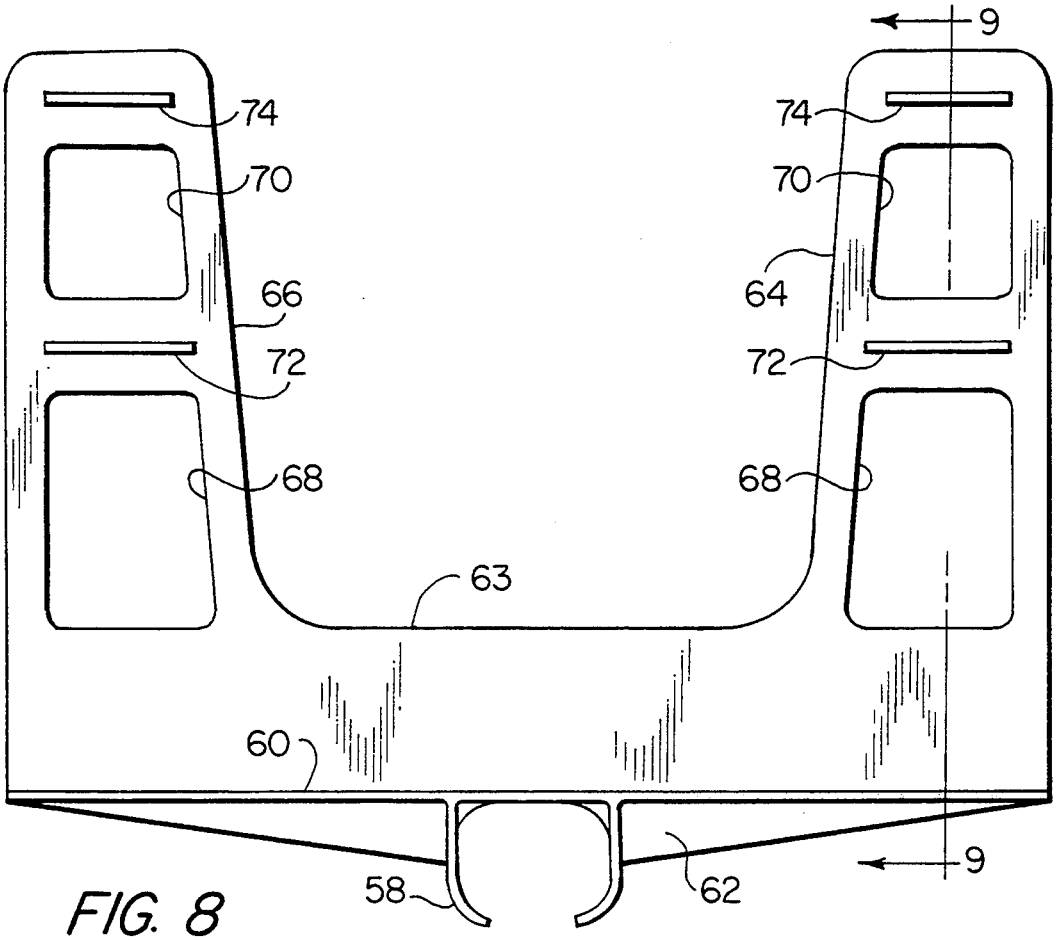
FIG. 8 is a view looking down onto the support base.
Figure 9:
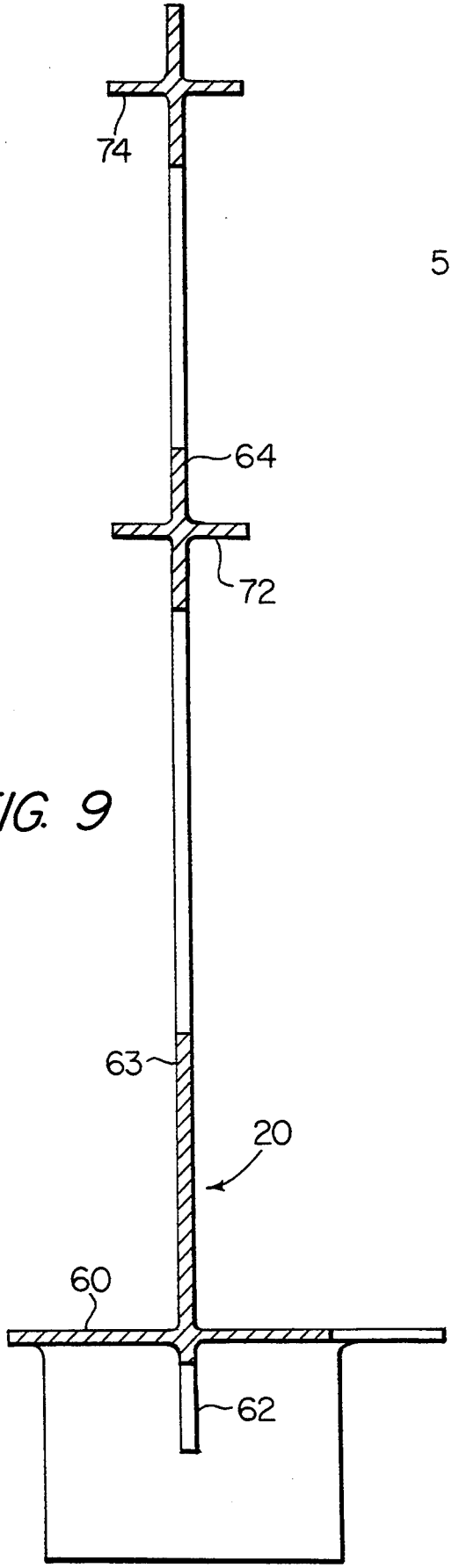
FIG. 9 is a view along 9—9 of FIG. 8 illustrating a cross section veiw of the supporting base.
Figure 11:
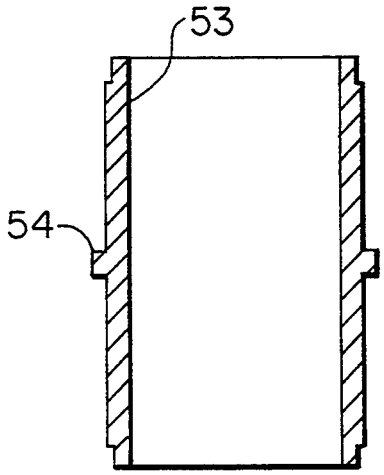
FIG. 11 illustrates a connector for connecting two or more support pieces together.

The support base is shown by a top view in FIG. 8 and a cross sectional view in FIG. 9. The support base includes a main body portion formed by a vertical wall 60 with a horizontal rib 62 that extends backwards which supports the bottom holder 58 and a forward extending rib 63 from which two spaced arms 64 and 66 extend forward. The arms are provided with openings 68 and 70, a middle rib 72 and an outer end rib 74. The ribs 72 and 74 are shown to be shorter than the downwardly vertical wall. This is for a model which is to be used for a bed game where the arms 64 and 66 are placed between a mattress and a spring. The vertical wall prevents the support base from extending too far under the mattress. In a model in which the support base is to be placed on the floor or a level surface, the support base would require a level bottom support.

In use, the vertical supports are assembled with one end in the bottom holder 58 with the upper end in the upper holder 34. The hoop is snapped into the clips 36 and the downwardly extending portion of the hoop prevents the hoop from falling downward and is so constructed to hold the hoop in a place substantially perpendicalar to the backboard. The support base is placed between the mattress and the spring which holds the vertical support in a vertical position with the backboard in a vertical plane. The person that is confined to the bed can then throw the ball towards the hoop while holding the loose end of the line. If a basket is made, then the ball will pass through the hoop and net and the line will pass through the slit in the hoop and down through the net. If the basket is missed the ball is retrieved by pulling on the line until the ball reaches the person. The same applies if the basket is made.

The end supports 42 for the hoop are round with spaced star-like sections, The end supports are made to be compatible with the clips so that the clips assist in holding the hoop in a paralled position. The hoop can be rotated upwardly in the clips so that the hoop is juxtaposed the front face of the backboard. Thus, the hoop and net can be removed to a position out of the way.

The device is easily assembed and disassembled which can be done by an unskilled person, including children.

For illustrative purposes the base has a main body which is 13 inches in overall length and the arms are approximately 9 inches in length from the main vertical wall 60. The upper and lower support holders 56, 58 for the vertical support are about 2 inches in overall diameter to receive the ends of the vertical support which is approximately 2 inches in diameter. The backboard has an overall height of approximately 10 inches with a width of about 13 inches. The hoop has an inside radius of about 3½ inches with a width of about 0.6 inch and a height of the U-shaped channel ¾ inch. The spacing between the support ends 42 of the hoop is about 3.5 inches therefore the back support surface 52 of the hoop is about 3.5 inches. Of course the device can be made smaller or larger without departing from the teaching of this invention. The ball is about 6 inches in diameter and can be made of any suitable material preferably a soft material. The line attached to the ball can be of any suitable length which must be of sufficient length to reach from the person throwing the ball to the top of the backboard. Further, the line may have a strap, arm band or some device for securing the line to the persons clothing or arm.

The net is secured with the upper end with the U-channel of the hoop with the netting secured to the elements 48 shown in FIG. 6.

A cover may be provided for the verticle support to keep anything from being dropped into the vertical support.

I claim:

1. A miniature basketball fun device which comprises a support base (20), a miniature backboard (24) supported by a vertical support (22) on said support base, vertically disposed spaced clips (36) integral with and extending perpendicular to a front face of said backboard, said spaced clips being positioned on a horizontal line, a generally circular hoop (26) mounted on said backboard, a slit (50) disposed in said generally circular hoop on a diameter of said generally circular hoop perpendicular to said backboard, a back side of said generally circular hoop includes integral end supports (42) which interfit into said spaced clips (36) on said front face of said miniature backboard about which said generally circular hoop is pivotable from a position in a plane perpendicular with said miniature backboard to a vertical position in parallel relationship with said miniature backboard, said back side of said generally circular hoop includes a downwardly extending support stop means which is integral with said generally circular hoop and said end supports (42) and which extends in a plane perpendicular to a diameter of said generally circular hoop through said slit, said downwardly extending support stop means is parallel with said front face of said backboard and supports said generally circular hoop in a position on a plane perpendicular with said miniature backboard, a miniature basketball (30), an elongated line (32) secured at one end to said miniature basketball, means on an opposite end of said elongated line for being held by a person, said miniature basketball adapted to be tossed into said generally circular hoop, and said elongated line is adapted to pass through said slit in said hoop when said miniature basketball passes through said hoop.

2. A miniature basketball fun device as set forth in claim 1 in which a slitted net is secured to said generally circular hoop, and said slit in said net is on a vertical line with said slit in said generally circular hoop.

3. A miniature basketball fun device as set forth in claim 1, in which said support base includes an upright support means for supporting an end of said vertical support opposite from said backboard.

4. A miniature basketball fun device as set forth in claim 3, in which said support base has a vertical main body portion with oppositely disposed parallel arms extending from a first side of said main body portion perpendicular with said main body portion, and a lower support member holder means secured to a mid-section of said support base on a back side thereof, said parallel arms of said support base extend forwardly parallel with said circular hoop and are adapted to be supported between a mattress and a boxspring for play from a bed.

5. A miniature basketball fun device as set forth in claim 4, in which each of said oppositely disposed arms extending from a first side of said main body include oppositely disposed upwardly and downwardly extending middle and outer end ribs (72 and 74) which are provided to aid in supporting said support base of said miniature basketball fun device between a mattress and a spring of a bed so that a bedridden person can enjoy playing basketball.

6. A miniature basketball fun device as set forth in claim 3, in which said means on an opposite end of said line is a strap which fits around a wrist of a user.

7. A miniature basketball fun device as set forth in claim 1, in which said means on an opposite end of said line is a strap which fits around a wrist of a user.

8. A miniature basketball fun device as set forth in claim 1, in which said vertical support (22) includes a plurality of interfitting parts, said interfitting parts include at least one coupling (53) which includes a central rib which supports adjoining interfitting parts of said vertical support (22).

9. A miniature basketball fun device as set forth in claim 8, in which said vertical support includes one coupling secured to said support base, at least one coupling between sections of interfitting parts, and one coupling which connects said vertical support to a holder (56) integral with a back side of said baseboard (24).

* * * * *